US008566968B2

(12) United States Patent
Marzec et al.

(10) Patent No.: US 8,566,968 B2
(45) Date of Patent: Oct. 29, 2013

(54) HELMET WITH COLUMNAR CUSHIONING

(75) Inventors: James Marzec, West Islip, NY (US); Charles Monchik, Glen Cove, NY (US)

(73) Assignee: Prostar Athletics LLC, Brooklyn, NY (US)

( * ) Notice: Subject to any disclaimer, the term of this patent is extended or adjusted under 35 U.S.C. 154(b) by 0 days.

(21) Appl. No.: 13/175,671

(22) Filed: Jul. 1, 2011

(65) Prior Publication Data

US 2013/0000015 A1 Jan. 3, 2013

(51) Int. Cl.
*A42B 3/00* (2006.01)

(52) U.S. Cl.
USPC ..... 2/411

(58) Field of Classification Search
USPC ..... 2/410, 411, 412, 414, 415, 417, 418, 2/419, 420, 425
See application file for complete search history.

(56) References Cited

U.S. PATENT DOCUMENTS

| | | | | |
|---|---|---|---|---|
| 1,886,551 | A | | 11/1932 | Jones |
| 3,054,111 | A | | 9/1962 | Hornickel et al. |
| 3,329,968 | A | | 7/1967 | Gordon |
| 3,590,388 | A | | 7/1971 | Holt |
| 3,633,214 | A | | 1/1972 | Newcomb |
| 3,797,039 | A | | 3/1974 | Penberthy |
| 3,916,446 | A | | 11/1975 | Gooding |
| D241,888 | S | | 10/1976 | Lipper |
| 3,994,020 | A | | 11/1976 | Villari |
| 4,064,565 | A | | 12/1977 | Griffiths |
| 4,345,338 | A | * | 8/1982 | Frieder et al. ..... 2/414 |
| 4,477,929 | A | | 10/1984 | Mattsson |
| 4,534,068 | A | * | 8/1985 | Mitchell et al. ..... 2/414 |
| 4,651,356 | A | | 3/1987 | Zide |
| 4,972,527 | A | | 11/1990 | Wallace |
| 5,175,889 | A | | 1/1993 | Infusino |
| 5,204,998 | A | | 4/1993 | Liu |
| 5,309,576 | A | * | 5/1994 | Broersma ..... 2/412 |
| D352,803 | S | | 11/1994 | Sasaki et al. |
| 5,428,846 | A | * | 7/1995 | Socci et al. ..... 2/425 |
| 5,450,631 | A | | 9/1995 | Egger |
| D367,341 | S | | 2/1996 | Losi, II |
| D372,559 | S | | 8/1996 | Murakami |
| D373,857 | S | | 9/1996 | Fujita |
| D378,236 | S | | 2/1997 | Zanotto et al. |
| 5,619,756 | A | | 4/1997 | Garneau |
| 5,651,145 | A | | 7/1997 | Egger |
| D383,249 | S | | 9/1997 | Ho |
| D387,501 | S | | 12/1997 | Cheng |
| 5,694,649 | A | | 12/1997 | Hefling et al. |
| 5,737,777 | A | | 4/1998 | Hilleary |
| 5,745,924 | A | | 5/1998 | Egger |
| 5,794,274 | A | | 8/1998 | Kraemer |
| 5,815,846 | A | | 10/1998 | Calonge |

(Continued)

*Primary Examiner* — Tejash Patel
(74) *Attorney, Agent, or Firm* — Dorsey & Whitney LLP

(57) ABSTRACT

Presently disclosed is a protective helmet, which may include a shell defining a shell exterior and a shell interior, and being configured to receive a wearer's head and extend to protectively cover the head circumferentially and vertically over the top of a wearer's skull; a first cushioning member disposed within the shell interior and configured for cushioning the skull; and a plurality of columnar cushioning members configured for supporting the shell on the skull and being configured for bending to allow rotational movement of the shell with respect to the skull, the columnar cushioning members having inner surfaces disposed further inwardly with respect to the shell than the first cushioning member surface to position the columnar member inner surfaces for resting against the skull and leaving a space between the first cushioning member inner surfaces and the skull.

29 Claims, 6 Drawing Sheets

(56) References Cited

U.S. PATENT DOCUMENTS

| | | | |
|---|---|---|---|
| 5,815,847 | A | 10/1998 | Holden, Jr. |
| 5,946,735 | A | 9/1999 | Bayes |
| 6,009,561 | A | 1/2000 | Bullock et al. |
| 6,178,560 | B1 | 1/2001 | Halstead et al. |
| 6,298,483 | B1 | 10/2001 | Schiebl et al. |
| 6,305,030 | B1 | 10/2001 | Brignone |
| 6,421,829 | B2 | 7/2002 | Halstead et al. |
| D464,174 | S | 10/2002 | Lu |
| D464,175 | S | 10/2002 | Chiang |
| 6,481,024 | B1 | 11/2002 | Grant |
| 6,530,092 | B2 | 3/2003 | Pope |
| 6,550,071 | B2 | 4/2003 | Garneau |
| 6,560,787 | B2 | 5/2003 | Mendoza |
| 6,591,428 | B2 | 7/2003 | Halstead et al. |
| 6,637,091 | B2 | 10/2003 | Halstead et al. |
| 6,665,884 | B1 | 12/2003 | Demps et al. |
| 6,711,751 | B1 | 3/2004 | Muskovitz |
| 6,763,524 | B2 | 7/2004 | Halstead et al. |
| 6,772,447 | B2 | 8/2004 | Morrow et al. |
| 6,804,829 | B2 | 10/2004 | Crye et al. |
| 7,159,249 | B2 | 1/2007 | Dennis et al. |
| 2002/0120978 | A1 | 9/2002 | Moore, III |
| 2002/0124298 | A1 | 9/2002 | Muskovitz |
| 2003/0056279 | A1 | 3/2003 | Garneau |
| 2003/0135914 | A1 | 7/2003 | Racine et al. |
| 2003/0167558 | A1 | 9/2003 | Broersma |
| 2004/0003452 | A1 | 1/2004 | Schiebl |
| 2004/0098793 | A1 | 5/2004 | Gershenson |
| 2004/0163161 | A1 | 8/2004 | Morrow et al. |
| 2004/0250340 | A1 | 12/2004 | Piper et al. |
| 2007/0209098 | A1 | 9/2007 | Peart |
| 2008/0256686 | A1 | 10/2008 | Ferrara |
| 2009/0222964 | A1 | 9/2009 | Wiles |

* cited by examiner

HELMET WITH COLUMNAR CUSHIONING

TECHNICAL FIELD

The present disclosure relates generally to protective headwear. More particularly, the disclosure relates to a protective helmet including columnar cushioning members.

BACKGROUND

Protective helmets and headwear are known to protect a wearer's head from accidental trauma. For example, construction workers are often required to wear hard hats or other safety headwear due to the increased risk of falling objects in and around construction sites. Similarly, athletes are required to wear protective helmets, such as football, baseball, hockey, lacrosse, skiing, snowboarding, skydiving, and cycling helmets, to protect their heads in case of high impact collisions. These helmets are typically made of a hard and durable material designed to deflect and disperse the effects of external forces imparted thereto.

Various components of protective helmets and headwear are generally known in the art and have been described in previous patent references. For example, U.S. Pat. No. 6,763,524 discloses a helmet with a faceguard, U.S. Pat. No. 6,711,751 discloses a helmet with a polycarbonate shell and foam liner, and U.S. Publication No. US 2002/0120978 discloses a helmet with a slow recovery, viscoelastic, polymeric foam liner.

In addition to the important protective characteristics of such helmets, the helmets also need to be comfortable when worn because the helmet is typically worn for extended periods of time. To accommodate people with different head sizes, protective helmets are typically manufactured in various standard sizes, such as, small, medium, large, and extra large. To further enhance the comfort, fit, and shock absorption of a helmet, some helmets also include an internal support within the interior of the helmet. The internal support is often adjustable to provide a custom fit on the wearer's head.

Recent advancements in sports medicine have uncovered a particularly dangerous risk to athletes where indirect contact is imparted to the athlete's head, causing rotational or shear forces to the athlete's head. These forces have been found to result in severe cranial injuries, particularly concussions. Traditional helmets are designed to prevent injury from extreme direct forces imparted to the head, such as a direct collision with another athlete at high speed. However, traditional helmets do not provide adequate protection against rotational or shear force, from glancing blows for example, that need not be nearly as powerful to cause a concussion or other severe injury as direct impact collisions.

Thus, there remains a need for a protective helmet that can provide cranial protection against rotational or shear forces, while still protecting against direct impact forces.

BRIEF SUMMARY OF THE DISCLOSURE

In one embodiment, disclosed herein is a protective helmet, which may include a shell defining a shell exterior and a shell interior, and being configured to receive a wearer's head and extend to protectively cover the head circumferentially and vertically over the top of a wearer's skull; a first cushioning member disposed within the shell interior and configured for cushioning the skull; and a plurality of columnar cushioning members configured for supporting the shell on the skull and being configured for bending to allow rotational movement of the shell with respect to the skull, the columnar cushioning members having inner surfaces disposed further inwardly with respect to the shell than the first cushioning member surface to position the columnar member inner surfaces for resting against the skull and leaving a space between the first cushioning member inner surfaces and the skull.

The inner surfaces of the columnar cushioning members may be disposed sufficiently inwardly from the shell for minimizing or preventing resistance against the rotation between the shell and the skull by the first cushioning layer. The first cushioning layer may have a thickness, and the columnar members may have an axial thickness that is greater than the first cushioning member thickness. The helmet may further include an adjustment member associated with the plurality of columnar cushioning members for adjusting the distance of the columnar cushioning member surfaces with respect to the shell to adjust ably fit the helmet to the user's head. The adjustment member may include a strap that extends through the interior of the columnar cushioning members. The plurality of columnar cushioning members may cumulatively comprise a surface area that is about 10% to about 50% of a total surface area of an equatorial region of the shell interior. A distance from the shell to the inner surfaces of the columnar cushioning members may be at least about 10% greater than a distance from the shell to an inner surface of the first cushioning member.

In another embodiment, disclosed herein is a protective helmet, which may include a shell defining a shell exterior and a shell interior, and being configured to receive a wearer's head and extend to protectively cover the head circumferentially and vertically over the top of a wearer's skull; and a plurality of columnar cushioning members extending inwardly from the shell interior, each columnar cushioning member having an outer end disposed adjacent the shell and an inner end disposed towards the interior of the shell, the columnar cushioning members configured for bending to allow rotational movement of the shell with respect to the skull, wherein the columnar cushioning members are configured for focusing the bending at a first axial station thereof.

The columnar support member may be made of a material having sufficient elasticity for supporting the shell on the skull and allowing the relative rotation, the material being less stiff at the first axial location than at a second axial location of the columnar cushioning members. The columnar cushioning members may further include a first and a second layer, wherein the first layer is disposed adjacent the shell interior and the second layer is disposed inward from and adjacent to the first layer, and wherein the first layer includes a material that is relatively more rigid than a material that comprises the second layer. The columnar cushioning member may be made of a material having sufficient elasticity for supporting the shell on the skull and allowing the relative rotation, the first station having a narrower cross-section than a second axial station of the columnar cushioning member. The narrower cross-section may have an area of less than about 80% of the cross-section at the second axial station. The first station may be at the outer end for facilitating tilting of the columnar cushioning member with respect to the shell. Alternatively, the first station may be at the inner end. The first station may be intermediate to the inner and outer ends for facilitating bending of the columnar support member between its ends. The columnar cushioning members may be substantially cylindrical in shape. The columnar cushioning members may be one or more shapes, including substantially conical, substantially, rectangular, substantially hour-glass, and substantially ovoid. It may further include a taper between the first and second stations. The columnar cushioning members may be arranged generally equatorially around the shell interior.

At least one columnar cushioning member may further be disposed vertically in the shell interior so as to be positioned over the top of the wearer's head.

In another embodiment, disclosed herein is a protective helmet, which may include a shell defining a shell exterior and a shell interior, and being configured to receive a wearer's head and extend to protectively cover the head circumferentially and vertically over the top of a wearer's skull; a plurality of columnar cushioning members disposed extending inwardly from the shell interior, the columnar cushioning members configured for bending to allow rotational movement of the shell with respect to the skull; and an adjustment member associated with the plurality of columnar cushioning members for adjusting the distance of the columnar cushioning member surfaces with respect to the shell to adjust ably fit the helmet to the user's head.

The columnar cushioning members may define an axial bore therethrough and the adjustment member comprises a strap that extends through the bores. The columnar cushioning members may be pulled away from the shell when the strap is tightened.

In yet another embodiment, disclosed herein is a protective helmet, which may include a shell defining a shell exterior and a shell interior, and being configured to receive a wearer's head and extend to protectively cover the head circumferentially and vertically over the top of a wearer's skull; and a plurality of columnar cushioning members disposed about the shell interior, wherein the columnar cushioning members are disposed over about 10%-50% of a surface area of the shell interior, wherein the cushioning members are disposed at least equatorially about the shell interior, and wherein the columnar cushioning members are configured for bending to allow rotational movement of the shell with respect to the skull. At least one columnar cushioning member may further be disposed vertically in the shell interior so as to be positioned over the top of the wearer's head.

While multiple embodiments are disclosed, still other embodiments in accordance with the present disclosure will become apparent to those skilled in the art from the following detailed description, which shows and describes illustrative embodiments. As will be realized, the disclosed embodiments are capable of modifications in various aspects, all without departing from the spirit and scope of thereof. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the embodiments will be better understood from the accompanying figures, in which:

DETAILED DESCRIPTION

Figure 1:
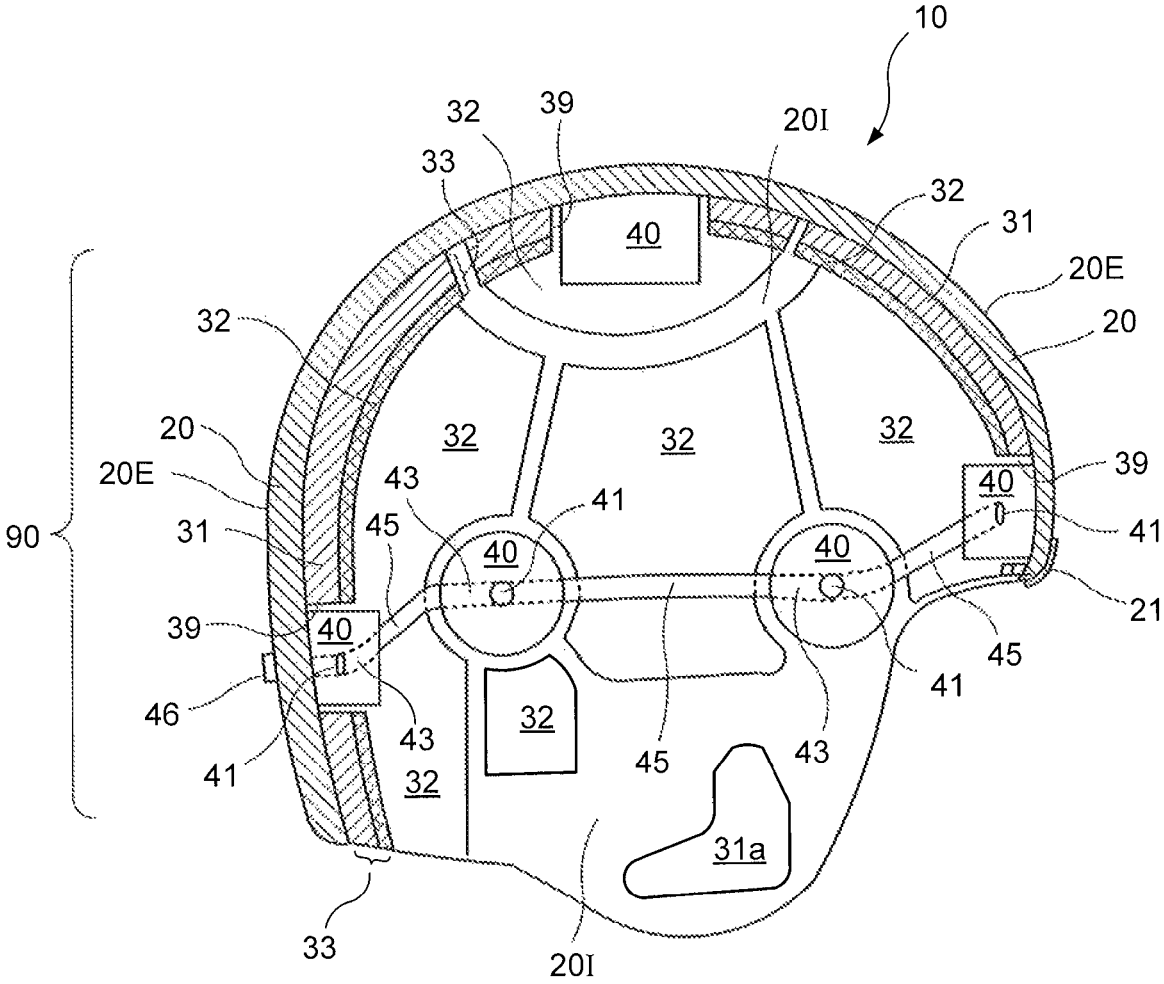
FIG. 1 is a side cross-sectional view of a protective helmet in accordance with one embodiment of the present disclosure.
Figure 2A:
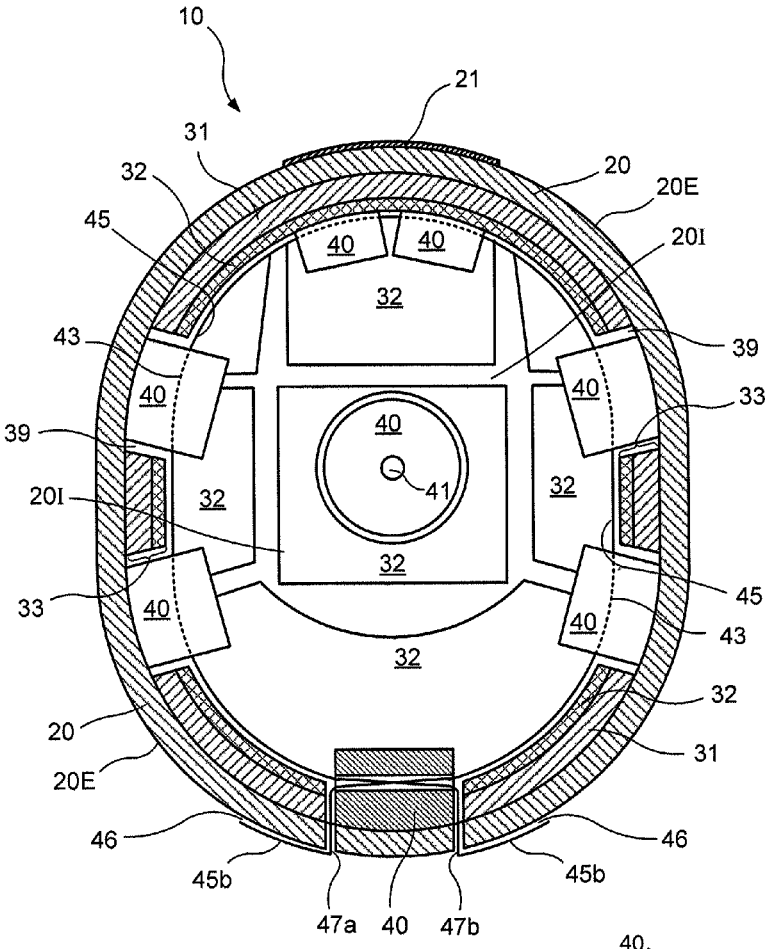
FIG. 2 is a bottom cross-sectional view of the protective helmet shown in FIG. 1.
Figure 2B:
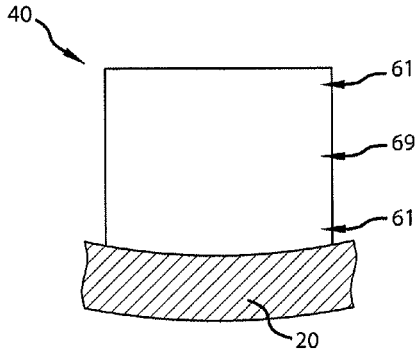
Figure 3A:
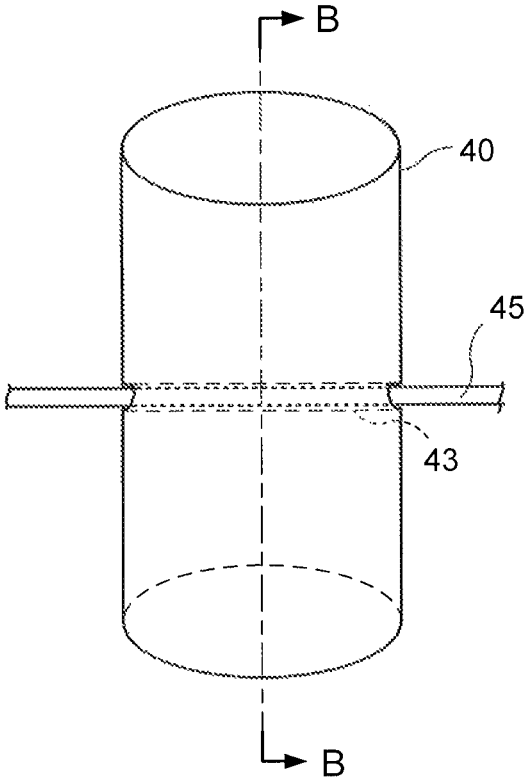
FIG. 3A is a perspective view of a cushioning member in accordance with one embodiment of the present disclosure.
Figure 3B:
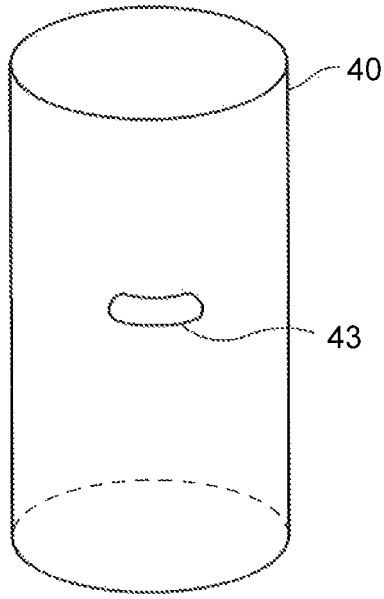
FIG. 3B is a perspective view along line B-B of the cushioning member shown in FIG. 3A.

The present disclosure is generally directed to a protective helmet that may be configured to cover and protect at least a portion of a wearer's head. Referring to a preferred embodiment as shown in FIGS. 1-2, a helmet 10 preferably may include a shell 20. The shell 20 may include an exterior surface 20E and an interior surface 20I. The interior surface 20I may be preferably configured to fit and receive the wearer's head therein. One of ordinary skill in the art will understand that the helmet 20 may be made in a variety of sizes to fit ranges of head sizes, for example, ranges of the standard head sizes for children and adults, which can be made in small, medium, large, and extra-large sizes, for example. Additionally, the shell 20 may be preferably made of a hard and durable material, such as a high-impact resistant polycarbonate or a high-impact resistant thermoplastic, although other suitable materials can be used.

A plurality of vents may be preferably disposed about the shell 20 (not shown). Advantageously, the vents reduce the overall weight of the helmet 10, and also provide cooling air to the wearer's head while the person is wearing the helmet 10. Additionally, the vents can provide a shock-absorbing system that allows air to be released from the interior of the helmet 20 instead of being compressed within the helmet upon impact or collision. This system advantageously can reduce the forces transmitted to the wearer's head that are caused by impact or collision. A suitable venting arrangement is shown and described in U.S. Pat. No. 7,870,617, the contents of which are herein incorporated by reference in their entirety. An alternate embodiment of the helmet does not include vents.

As shown in FIGS. 1 and 2, the helmet 10 may also preferably include one or more internal cushioning layers 33 (which may be continuous or discontinuous) about the interior surface 20I of the shell 20 that may be configured for providing further protection around the wearer's head. Each internal cushioning layer 33 can be made of one or more adjacent and contiguous material layers, which may include one or more shock absorbing materials, such as a foam or a gel. As shown in FIGS. 1 and 2, the internal cushioning layer 33 includes two adjacent material layers 31 and 32. Material layer 31, disposed and adhered adjacent to the shell 20, may include an air cushion material. Material layer 32, disposed and adhered to the material layer 31 inwardly from the shell, may include a foam material. Of course, more or fewer material layers may be provided in the internal cushioning layers 33, and other cushioning materials may be provided. In some embodiments, layers 31 and 32 may be replaced with a single, homogenous layer, such as of foam. In others, the layers 31 and 31 may provide a heterogeneous layer.

The thickness of material layer 31 may be between about 0.2 inches and 2 inches, between about 0.5 inches and 1.5 inches, or more preferably between about 0.75 inches and 1.25 inches. The thickness of material layer 32 may be between about 0.1 inches and 1 inch, between about 0.15 inches and 0.75 inches, or more preferably between about 0.2 inches and 0.5 inches. Thus, the overall thickness of the internal cushioning layer 33 may be between about 0.1 inches and 3 inches, 0.5 inches and 2 inches, or more preferably between about 0.75 inches and 1.5 inches.

The internal cushioning layer 33, and/or the material layers that comprise said cushioning layer, may preferably be light in weight, and preferably have a slow memory to increase the time of deceleration upon impact or collision to the helmet 10. This quality may also advantageously reduce the forces transmitted to the wearer's head that are caused by impact or collision. In some embodiments, the layer 33 (or material layer 32 specifically, which is a part of layer 33) may be preferably made of a relatively elastic material so as to retain a comfortable fit on the wearer's head during extended wear. More preferably, this layer may be made of a wickable material, such as polypropylene, to wick away any perspiration that may build up in the areas where it contacts the wearer's head. When combined with the vents in the shell 20 as described above, the wickable material advantageously allows for efficient dissipation of heat and perspiration to keep the wearer's head comfortable during extended wear. Other materials, such as leather or plastic, can alternatively be used.

In some embodiments (not shown), the helmet 10 may also preferably includes a guard, such as a face guard, and/or a chin strap. The face guard may be mounted, and preferably is fixedly coupled, to the shell 20, such as by fasteners, including threaded fasteners, or by welding, and may be configured to cover at least a portion of the wearer's head, and preferably the face, when the helmet 10 is worn. Preferably, the face guard may be made of a rigid material. Suitable materials may include titanium, and the preferred face guard may have an open, cage-like configuration. The chin strap may be preferably removably coupled to the shell 20 at fastening locations on either side of the shell exterior 32. When the person is wearing the helmet 10, the ends of the chin strap may be configured to fasten to either side of the shell 20 at fastening locations, and the portion of the chin strap between the ends may be configured to associate with the wearer's chin to prevent or resist removal of the helmet 10 from the wearer's head. Suitable guard and/or chin strap arrangements are shown and described in U.S. Pat. No. 7,870,617.

In some embodiments, disposed within the internal cushioning layers 33 (the layers 33 may have "cut-outs" therefrom) may be a plurality of cushioning members 40. There may be a space 39 between the edge of the layer 33 and the members 40. The cushioning members 40 may be configured for bending to allow rotational movement of the shell with respect to the skull, the columnar cushioning members having inner surfaces disposed further inwardly with respect to the shell than the first cushioning member surface to position the columnar member inner surfaces for resting against the skull and leaving a space between the first cushioning member inner surfaces and the skull. In preferred embodiments, the cushioning members 40 may be generally columnar is shape, although other shapes are possible. The columnar cushioning members 40 may be disposed anywhere along the interior of the helmet 10. Columnar cushioning members 40 may be disposed directly onto the interior surface of the shell, or they may be disposed on one or more intermediate layers that are adjacent to the interior surface of the shell. As shown in FIGS. 1 and 2, columnar cushioning members are disposed equatorially about the interior of the helmet 10 (i.e., generally positioned so as to be substantially adjacent to all of the frontal, temporal, and occipital regions of the wearer's cranium, as roughly indicated by reference numeral 90 in FIG. 1), in addition to the top portion of the helmet 10 (i.e., positioned so as to be adjacent to the parietal region of the wearer's cranium). The columnar cushioning members 40 may be arranged generally equatorially around the shell interior 20I. At least one columnar cushioning member 40 may further be disposed vertically in the shell interior 20I so as to be positioned over the top of the wearer's head. However, it will be appreciated that the columnar support members 20 can be disposed within the helmet in any number, in any orientation or configuration, and at any position or positions.

The inner surfaces of the columnar cushioning members 40 may be disposed sufficiently inwardly from the shell for minimizing or preventing resistance against the rotation between the shell and the skull by the internal cushioning layer 33. The internal cushioning layer 33 may have a thickness, and the columnar members 40 may have an axial thickness that is greater than the first cushioning member thickness. The plurality of columnar cushioning members 40 may cumulatively comprise a surface area that is about 10% to about 50% of a total surface area of an equatorial region of the shell interior. A distance from the shell 20 to the inner surfaces of the columnar cushioning members 40 may be at least about 10% greater than a distance from the shell 20 to an inner surface of the internal cushioning layer. In this manner, the cushioning members 40 are situated proud from the cushioning layer 33.

Each columnar cushioning member 40 may have an outer end disposed adjacent the shell 20 and an inner end disposed towards the interior of the shell. The columnar cushioning members 40 configured for bending to allow rotational movement of the shell with respect to the skull. The columnar cushioning members 40 are configured for focusing the bending at a first axial station thereof. The columnar cushioning members, alone or in combination with the internal support layer, may be configured to take a direct linear impact.

Figure 5A:
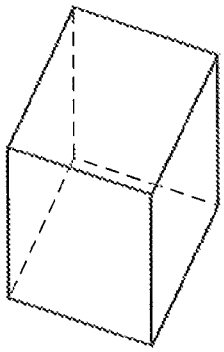
FIGS. 5A-5I depict alternative embodiments of cushioning members in accordance with the present disclosure.
Figure 5D:
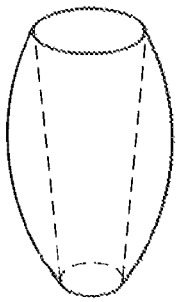
Figure 5G:
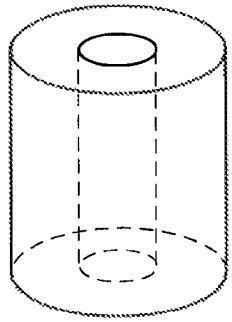
Figure 5B:
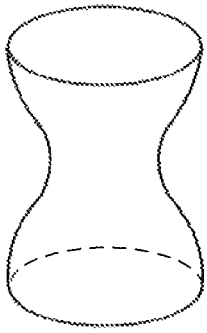
Figure 5E:
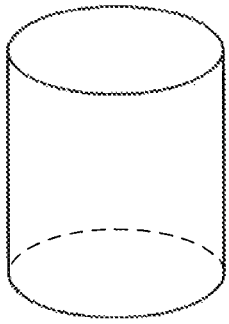
Figure 5H:
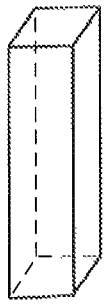
Figure 5C:
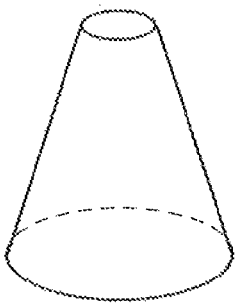
Figure 5F:
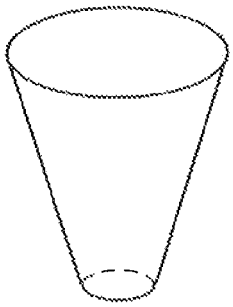

As shown in FIGS. 1 and 2, the cushioning members 40 may be generally cylindrically columnar in shape, with a central bore 41 passing therethrough axially. However, other columnar shapes are possible, as well as other shapes that are not necessarily columnar. As shown in FIGS. 5A-5H, columnar shapes of members 40 may include, but are not limited to, generally cubic (FIG. 5A), generally hour-glass shaped (FIG. 5B), generally conical in an upright orientation (FIG. 5C) or in a downward orientation (FIG. 5F), generally ovoid (FIG. 5D), generally cylindrical with (FIG. 5E) or without (FIG. 5G) a central bore, and generally rectangular (FIG. 5H). As shown with regard to FIGS. 5A-D and 5F, at least a first portion of the columnar support is narrower along the axial length thereof than another (second) portion (resulting the in hour-glass and cone shapes, etc.). Where an axial bore is included, such bore may be configured to provide a shock-absorbing system that allows air to be released from the interior of the helmet 10 instead of being compressed within the helmet upon impact or collision. This system advantageously can reduce the forces transmitted to the wearer's head that are caused by impact or collision. In some embodiments, the columnar cushioning members 40 may further include a transverse bore 43, the function of which will be discussed in greater detail below. It will appreciated that in any helmet, cushioning members may be provided in one, two, three, or more different shapes, including both shapes that are columnar and shapes that are non-columnar.

The columnar cushioning members 40 may generally have a width that ranges between about 0.5 inches and 5 inches, between about 1 inch and 4 inches, or more preferably between about 2 inches and 3 inches. Where an axial bore is provided, such bore may have a width between about 0.05 inches and 1 inch, or preferably between about 0.1 inches and 0.75 inches. Where a transverse bore is provided, such bore may have a width between about 0.05 inches and 1 inch, or preferably between about 0.1 inches and 0.75 inches. The columnar cushioning members 40 may generally have an axial length between about 0.5 inches and 3 inches, between about 0.75 inches and 2.5 inches, or more preferably between about 1 inch and 2 inches.

With regard to the relative proportions between the cushioning members 40 and the internal cushioning layer 33, the ratio between the thickness of the internal cushioning layer 33 and the axial length of the cushioning members may be between about 1:1.1 and 1:5, or preferably between about 1:1.5 and 1:3. In a preferred embodiment, this ratio is between about 1:2 and 3:4. With regard to the relative proportions between the inner surface area of the cushioning members (i.e., the inward facing surface area that abuts the wearers head when wearing the helmet 10) and the total interior surface area of the helmet or shell (20I), the combined inner surface area of all the cushioning members 40 may be between about 10% and 70% of the total interior surface area, between about 10% and 50%, or more preferably between about 20% and 40% of the total interior surface area of the helmet or shell (20I). Alternatively, it may be at least about 10%, 20%, 30%, or 40%, and can be, for example, less that about 60%, 50%, 40%, 30%, or 20%.

The columnar cushioning members 40 may be made of one or more materials. In a preferred embodiment, the columnar cushioning members may be made of a first layer, adjacent to the interior shell surface 20I, that includes a relatively rigid material, e.g., a rigid foam material. A second layer, adjacent to the first layer and designed to be in direct contact with the wearer's head may be made of a relatively softer material, for example, a relatively more soft foam material than the material comprising the first layer. In some embodiments, this second layer may be preferably made of a relatively elastic material so as to retain a comfortable fit on the wearer's head during extended wear. More preferably, the second layer may be made of a wickable material, such as polypropylene, to wick away any perspiration that may build up in the areas where it contacts the wearer's head. When combined with the vents in the shell 20 as described above, the wickable material advantageously allows for efficient dissipation of heat and perspiration to keep the wearer's head comfortable during extended wear. Other materials, such as leather or plastic, can alternatively be used.

Figure 5I:
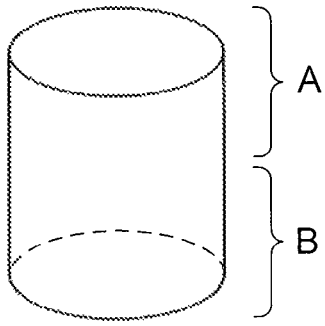

The columnar cushioning members 40 may be made of a material having sufficient elasticity for supporting the shell on the skull and allowing the relative rotation, the material being less stiff at the first axial location than at a second axial location of the columnar cushioning members. The columnar cushioning members may further include a first and a second layer, as indicated by portions "A" and "B" in FIG. 5I, wherein the first layer is disposed adjacent the shell interior and the second layer is disposed inward from and adjacent to the first layer, and wherein the first layer includes a material that is relatively more rigid than a material that comprises the second layer. The columnar cushioning member 40 may be made of a material having sufficient elasticity for supporting the shell on the skull and allowing the relative rotation, the first station having a narrower cross-section than a second axial station of the columnar cushioning member. The narrower cross-section may have an area of less than about 80% of the cross-section at the second axial station. The first station may be at the outer end for facilitating tilting of the columnar cushioning member with respect to the shell. Alternatively, the first station may be at the inner end. The first station may be intermediate to the inner and outer ends for facilitating bending of the columnar support member between its ends. The columnar cushioning members may be substantially cylindrical in shape. The columnar cushioning members may be one or more shapes, including substantially conical, substantially, rectangular, substantially hour-glass, and substantially ovoid. It may further include a taper between the first and second stations.

Elasticity of the overall cushioning member 40 may be sufficient to allow the member to quickly return to its original form after an applied force is released. For example, after an impact to a helmet, the columnar cushioning members should be able to quickly reform their shape after the deformation caused by the impact. It will be appreciated that cushioning member shapes such as shown in FIGS. 5A-D and 5F, where at least one portion is narrower than other portions along the axial length, allow a higher degree of elastic deformation (by bending at the narrow region) than, for example, pure cylindrical shapes. This additional elastic deformation may provide greater protection to the head against rotational forces that would otherwise be imparted by the helmet during certain impacts.

Figure 4:
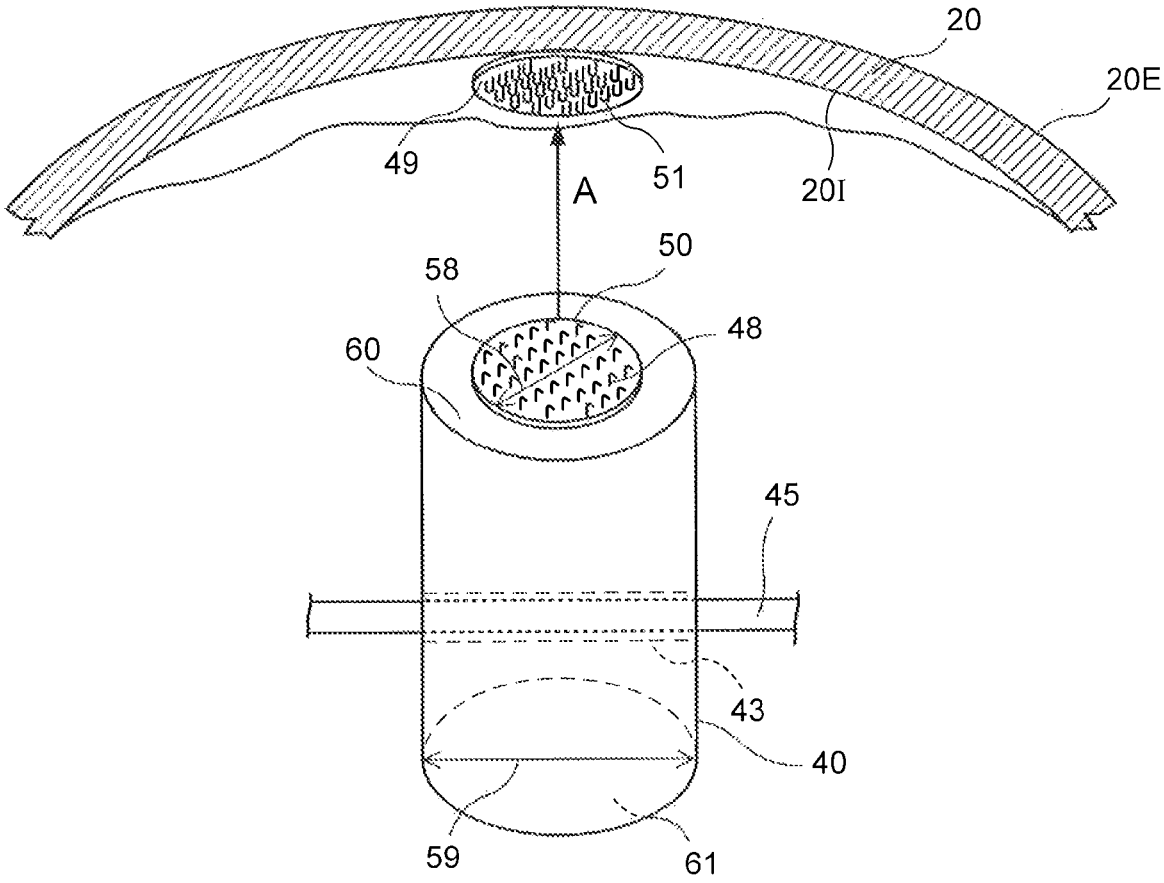
FIG. 4 is a perspective view of a cushioning member in accordance with one embodiment of the present disclosure showing its attachment to the helmet.

With reference to FIG. 4, a columnar cushioning member 40 is shown with an affixing portion 48 disposed on the surface 60 thereof that is positioned adjacent to the interior surface of the shell 20I. Complementing the affixing portion 48 there is shown a securing portion 49 disposed on the interior surface of the shell 20I. In some embodiments, the affixing portion may include less than all of the surface area 60 of the columnar cushioning member. The percentage of the surface area 60 occupied by the affixing portion 48 may be less than about 90%, less than about 80%, less than about 70%, less than about 60%, less than about 50%, less than about 40%, less than about 30%, less than about 20%, or less than about 10%. In other embodiments, the affixing portion occupies substantially all of the surface area 60. The affixing portion 48 may be configured for mating attachment with the securing portion 49 (as indicated by the arrow "A"). As such, the securing portion 49 may be about the same size and shape as the affixing portion 48, though this need not necessarily be so. In some embodiments, the mating attachment may be detachable, although the attachment may be permanent (using adhesive means, for example). In a preferred embodiment, the affixing portion may include a plurality of hooks 50, and the securing portion may include a plurality of loops 51. A suitable hook-and-loop configuration is Velcro®, as sold by the Velcro company of Manchester, N.H. Of course, adhesive, hot melt, glue, etc. may be used between portions 48, 49 if the mating therebetween is desired to be permanent. Other suitable fasteners can be used, such as rivets or snaps. As shown in FIG. 4, the portion 48 may have a width 58, and the internal facing surface may have a width 59.

The presently described securement configuration between the shell 20 and the columnar cushioning members 40 exhibits various advantages. Because the affixing portion only occupies a portion of the columnar cushioning member surface area 60, the columnar cushioning member retains some freedom of movement (i.e., displacement of the inner surface relative to the outer surface) from the normal orientation (i.e., perpendicular) with the shell interior surface 20I. For example, in some embodiments, the columnar cushioning members 40 may be able to have a displacement of the inner surface 60 relative to the outer surface 61 and move within a range of at least about 5°, 10°, or 20° from normal, and preferably up to about 30° or up to or over about 45° degrees from normal, during a hard glancing impact to the shell. It will be appreciated that the size of the affixing portion 48 is inversely related to the range of displacement of the inner surface relative to the outer surface through which the columnar cushioning members 40 will be able to move. In some embodiments, the size of portion 48 can be decreased compared to the outer surface of the columnar member 40 in a manner that increases the range of displacement of the inner surface relative to the shell, for instance, by allowing part of the columnar member 40 to pull away from the shell. In some embodiments, the columnar cushioning members may not be connected directly to the shell interior 20I, but rather there may be a liner present to which such members 40 are attached. The liner may be movable with respect to, or it may be affixed to, the shell.

Displacement of the inner surface relative to the outer surface of the columnar cushioning members may enable a rotational effect with respect to forces imparted from the helmet 10 to the wearer's head that may be caused by direct or side impacts to the helmet. That is, when the helmet 10, while in use protecting the wearer, is subjected to a direct or glancing blow that causes rotation of the helmet, rather than imparting all of this rotational movement to the wearer's head (which could result in a severe concussion), the columnar cushioning members may move relative to the wearer's head, thereby rotate relative to the wearer's head. In this manner, the wearer is better protected from rotation or shear-induced head injuries than traditional helmets that have substantially all of their interior surface area in direct contact with the wearer's head.

In some embodiments, and adjustment member 45 may be preferably associated with (at least some of) the plurality of columnar cushioning members 40 for adjusting the orientation of the columnar cushioning members 40 to fit the wearer's head. Preferably, the adjustment member 45 may be operable to adjust the columnar cushioning members 40 from outside the shell 20, to enable adjustments while the person is wearing the helmet 10. In one embodiment, the adjustments to the columnar cushioning members 40 can be made with the aid of another person, such as a teammate, trainer, or co-worker, or alternatively by the wearer himself or herself. The adjustment member can include a closed loop or an open loop that extends equatorially around the inside of the helmet, as shown in FIGS. 1 and 2. In some embodiments, the adjustment member 45 may be a continuous fabric strap.

The adjustment member 45, as shown in FIGS. 1 and 2, includes end portions 45*a*, 45*b*. Preferably, the end portions 45*a*, 45*b* extend from the shell interior 20I to the shell exterior 20E such that the end portions 45*a*, 45*b* can be manipulated from outside the shell 20 to adjust the circumference of the columnar cushioning members 40 associated therewith (for example, the equatorially oriented columnar cushioning members 40, as discussed above). For example, the end portions 45*a*, 45*b* can be pulled in the direction away from the exterior surface of the shell 20E to decrease the circumference of the equatorially oriented columnar cushioning members 40 and thus reduce the size of the internal helmet area that is fitted on the wearer's head. The shell 20 preferably includes two apertures 47*a*, 47*b*, preferably located near the portion of the shell 20 that covers the occipital protuberance of the wearer's head, and the end portions 45*a*, 45*b* may be configured to extend through the apertures 47*a*, 47*b*, respectively, so to permit manipulation of the end portions 45*a*, 45*b* from outside the shell 20 to adjust the sizing of the columnar cushioning configuration, such that the support members 40 can be moved closer to or farther from the wearer's head when worn to achieve a tighter or looser fit, respectively.

As shown in FIGS. 1-4 (and particularly in FIGS. 3 and 4), adjustment member 45 may extend through a trasverse bore in the columnar cushioning member 40 to provide the association therewith, as described above. FIG. 3A shows the support member 45 extending through the transverse bore 43 from a side view, while FIG. 3B shows the bore frontally, without the adjustment member present. FIG. 4 shows the adjustment member 45, through the bore 43, in relation to the affixing portion 48 and the securing portion 49. As will be appreciated, when the adjustment member 45 is manipulated (e.g., pulled from outside the helmet 10 as discussed above), the columnar cushioning members 40 will change their orientation (e.g., they will be pulled in a direction corresponding to the tension forces of the adjustment member 45. The columnar cushioning members 40 will remain securely in place by virtue of its mating attachment to the shell interior 20I, but will be reoriented as the adjustment member is manipulated. This reorientation may provide a better fit for the wearer, as the interior volume of the helmet 10 may increase/decrease and/or change shape to accommodate the wearer's head.

After adjustment of the end portions 45*a*, 45*b* to provide a proper fit of the columnar cushioning members 40 to the wearer's head, the columnar cushioning members 40 are preferably fixed in the selected adjusted position. For example, the end portions 45*a*, 45*b* may be removably fixed to the exterior surface of the shell 20E to maintain the columnar cushioning members 40 in the adjusted position about the wearer's head. Alternatively, the end portions 45*a*, 45*b* may be removably fixed to each other outside the shell 20 to maintain the adjusted position of the columnar cushioning members 40. Removably fixing the end portions 45*a*, 45*b* outside the shell 20 is preferably achieved by using engagement members 46, which, for example, may be disengageable fasteners such as clips, snaps, ties, buckles, hook and loop fasteners, screws, or bolts.

As shown in FIG. 2, an embodiment of the shell 20 includes at least two engagement members 46 that are configured for receiving the end portions 45*a*, 45*b*. For example, the engagement member 46 of FIG. 2 is a hook-and-loop configuration. Alternative embodiments can have clasps, hooks, strap buckles, snaps, or other suitable buckles and engagement portions. Various configurations of engagement members 46 are disclosed in U.S. Pat. No. 7,870,617.

In another embodiment, the shell 20 includes a single aperture through which both end portions of the internal support pass for manipulation of the end portions 45*a*, 45*b* outside of the shell 20. In one embodiment, as shown in FIG. 2, the end portions 45*a*, 45*b* criss-cross one another, preferably within rear columnar member 40. In this manner, the adjustment member may be able to more securely and easily position the columnar cushioning members for a secure fit over the wearer's head. In another embodiment, the ends 45*a*, 45*b* do not cross one another, and remain on respective sides of the helmet exterior from one another. In yet another embodiment, the adjustment member 45 includes a single end portion that is configured to pass through a single aperture in the shell for manipulation outside the shell, and the adjustment member be a closed or open loop. Alternatively, the adjustment member 45 can be configured to extend from the bottom of the helmet such that it is operable for adjusting the internal support near the back of the wearer's neck, or it can be adjustable from within the shell when removed from a wearer's head.

In some embodiments, a cover (not shown) that is configured for removably mounting to the exterior surface 20E to preferably cover at least a portion of the apertures 47*a*, 47*b* and/or the end portions 45*a*, 45*b* extending through the apertures 47*a*, 47*b* and fixed outside the shell 20. Preferably, the cover is also made of a hard, durable, and preferably resilient material, such as polycarbonate or a hard thermoplastic. When attached to the exterior surface 20E, the cover advantageously protects the end portions 45*a*, 45*b* and may prevent them from becoming unsecured due to incidental interference or impact with the exterior surface 20E. Suitable cover configurations are shown and described in U.S. Pat. No. 7,870,617.

In some embodiments, one or more padding members 31*a* may be provided as additional protection against the temporal regions of the wearer's cranium. Padding members may be comprised of any material, including, for example, gels, air cells, foams, plastics, etc. Other padding members may optionally be included within the interior portions for additional protection for particularly susceptible areas. The padding member 31*a* has a generally "L" shape, and may have a thickness similar to the internal cushioning layer 33. In alternative embodiments, the internal cushioning layer 33 may replace the padding members 31*a*. Further, in some embodiments, a branding label 21 may be applied to a frontal area on the exterior surface of the shell 20E.

Figure 6:
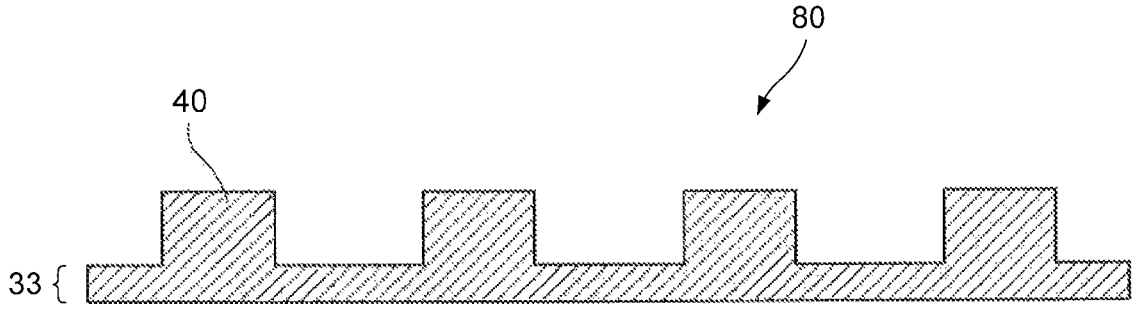
FIG. 6 depicts an alternative embodiment of a cushioning layer integrally formed with a plurality of columnar cushioning members.

FIG. 6 shows an alternative embodiment wherein the columnar cushioning members 40 and the internal support layer 33 are not separate layers, but rather are an integral component 80. As shown in FIG. 6, the layer 33 comprises a plurality of members 40, which form an integral unit 80.

The terms "substantially" or "generally" as used herein to refer to a shape, e.g., substantially or generally cylindrical, is intended to include variations from the true shape that do not affect the overall function of the device. The term "about," as used herein, should generally be understood to refer to both numbers in a range of numerals. Moreover, all numerical ranges herein should be understood to include each whole integer within the range. The terms "front," "back," "upper," "lower," "side" and/or other terms indicative of direction are used herein for convenience and to depict relational positions and/or directions between the parts of the embodiments. It will be appreciated that certain embodiments, or portions thereof, can also be oriented in other positions.

While illustrative embodiments are disclosed herein, it will be appreciated that numerous modifications and other embodiments can be devised by those of ordinary skill in the art. Features of the embodiments described herein can be combined, separated, interchanged, and/or rearranged to generate other embodiments. Therefore, it will be understood that the appended claims are intended to cover all such modifications and embodiments that come within the spirit and scope of the present disclosure.

What is claimed is:

1. A protective helmet, comprising:

a shell defining a shell exterior and a shell interior, and being configured to receive a wearer's head and extend to protectively cover the head circumferentially and vertically over the top of a wearer's skull;

a first cushioning member disposed within the shell interior and configured for cushioning the skull; and a plurality of columnar cushioning members configured for supporting the shell on the skull, wherein:

the columnar cushioning members have inner surfaces disposed further inwardly with respect to the shell than the first cushioning member surface to position the columnar member inner surfaces for resting against the skull and to leave a space between the first cushioning member inner surfaces and the skull, and the columnar cushioning members are flexible in bending to allow rotational movement of the shell with respect to the skull, and the columnar cushioning members and the first cushioning member define gaps therebetween, sufficient to prevent or reduce resistance against rotation between the shell and skull to prevent or significantly reduce incidence of concussions.

2. The protective helmet of claim 1, wherein the first cushioning layer has a thickness, and the columnar members have an axial thickness that is greater than the first cushioning member thickness.

3. The protective helmet of claim 1, further comprising an adjustment member associated with the plurality of columnar cushioning members for adjusting the distance of the columnar cushioning member surfaces with respect to the shell to adjust ably fit the helmet to the user's head.

4. The protective helmet of claim 1, wherein the adjustment member comprises a strap that extends through the interior of the columnar cushioning members.

5. The protective helmet of claim 1, wherein a distance from the shell to the inner surfaces of the columnar cushioning members are at least about 10% greater than a distance from the shell to an inner surface of the first cushioning member.

6. The protective helmet of claim 1, wherein the columnar cushioning members are configured for focusing the bending at a first axial station thereof.

7. The protective helmet of claim 6, wherein the columnar cushioning members are made of a material having sufficient elasticity for supporting the shell on the skull and allowing the relative rotation, the material being less stiff at the first axial station than at a second axial station of the columnar cushioning members to focus the bending at the first axial station.

8. The protective helmet of claim 7, wherein the columnar cushioning members comprise a first and a second layer, wherein the first layer is disposed adjacent the shell interior and the second layer is disposed inward from and adjacent to the first layer, and wherein the first layer comprises a material that is relatively more rigid than a material that comprises the second layer.

9. The protective helmet of claim 6, wherein the columnar cushioning members are made of a material having sufficient elasticity for supporting the shell on the skull and allowing the relative rotation, the first axial station having a narrower cross-section than a second axial station of the columnar cushioning members so that the columnar cushioning members are significantly more flexible in the first axial station than in the second axial station to focus the bending at the first axial station.

10. The protective helmet of claim 9, wherein the narrower cross-section has an area of less than about 80% of the cross-section at the second axial station.

11. The protective helmet of claim 9, wherein the first axial station is at the outer end for facilitating tilting of the columnar cushioning members with respect to the shell.

12. The protective helmet of claim 9, wherein the first station is at the inner end.

13. The protective helmet of claim 9, wherein the first station is intermediate to the inner and outer ends for facilitating bending of the columnar support members between its ends.

14. The protective helmet of claim 9, wherein the columnar cushioning members are substantially cylindrical in shape.

15. The protective helmet of claim 9, wherein the columnar cushioning members comprise one or more shapes selected from the group consisting of: substantially conical, substantially rectangular, substantially hour-glass, and substantially ovoid.

16. The protective helmet of claim 9, further comprising a taper between the first and second stations.

17. The protective helmet of claim 1, wherein at least one columnar cushioning member is further disposed vertically in the shell interior so as to be positioned over the top of the wearer's head.

18. A protective helmet, comprising:

a shell defining a shell exterior and a shell interior, and being configured to receive a wearer's head and extend to protectively cover the head circumferentially and vertically over the top of a wearer's skull;

a plurality of columnar cushioning members extending inwardly from the shell interior, each columnar cushioning member having an outer end affixed to the shell interior and an inner end disposed towards the interior of the shell, the columnar cushioning members configured for bending to allow rotational movement of the shell with respect to the skull; and an adjustment member associated with the plurality of columnar cushioning members for adjusting the distance of the columnar cushioning member inner ends with respect to the shell to adjust ably fit the helmet to the user's head.

19. The protective helmet of claim 18, wherein the columnar cushioning members define a transverse bore therethrough and the adjustment member comprises a strap that extends through the bores.

20. The protective helmet of claim 18, wherein columnar cushioning members are disposed in frontal, temporal, and occipital regions of the shell interior.

21. The protective helmet of claim 18 wherein the columnar cushioning members have intermediate portions between the inner and outer ends, the adjustment member being associated with the columnar cushioning members at intermediate portions for adjusting the distance of the columnar cushioning member inner end with respect to the shell to adjust ably fit the helmet to the user's head.

22. The protective helmet of claim 21, wherein the columnar cushioning members have increased flexibility at the intermediate portions compared to the inner and outer ends to focus the bending at the intermediate portion.

23. The protective helmet of claim 21, wherein the plurality of columnar cushioning members cumulatively comprise a surface area that is about 10% to about 50% of a total surface area of the equatorial region of the shell interior.

24. The protective helmet of claim 23, wherein the columnar cushioning members disposed over a region above the equatorial region occupy less total surface area than the total surface area of columnar cushioning members disposed at the equatorial region.

25. A protective helmet, comprising:

a shell defining a shell exterior and a shell interior, and being configured to receive a wearer's head and extend to protectively cover the head circumferentially and vertically over the top of a wearer's skull; and a plurality of columnar cushioning members made from a material having sufficient elasticity for supporting the shell on the skull and allow relative rotation, wherein the columnar cushioning members extend inwardly from the shell interior and each columnar cushioning member has an outer end attached to the shell and an inner end disposed towards the interior of the shell, the columnar cushioning members comprising:

a first layer disposed at a first axial station of the columnar cushioning members; and a second layer disposed adjacent the shell and to the first layer at a second axial location of the columnar cushioning members wherein the second layer is stiffer to allow bending of the columnar cushioning members and rotational movement of the shell with respect to the skull, with said bending being focused at the first axial station thereof.

26. The protective helmet of claim 25, wherein:

the first layer is made of a first material; and the second layer is made of a second material that is stiffer than the first material.

27. The protective helmet of claim 26, wherein the first and second materials are foam materials.

28. The protective helmet of claim 25, further comprising a first cushioning member disposed within the shell interior and configured for cushioning the skull, each of the columnar cushioning members and the first cushioning member define a gap therebetween.

29. A protective helmet, comprising:

a shell defining a shell exterior and a shell interior, and being configured to receive a wearer's head and extend to protectively cover the head circumferentially and vertically over the top of a wearer's skull;

a plurality of columnar cushioning members disposed extending inwardly from the shell interior, each columnar cushioning member having an inner end disposed towards the interior of the shell, the columnar cushioning members configured for bending to allow rotational movement of the shell with respect to the skull; and an adjustment member associated with the plurality of columnar cushioning members for adjusting the distance of the columnar cushioning member inner ends with respect to the shell to adjust ably fit the helmet to the user's head, wherein the columnar cushioning members define a transverse bore therethrough and the adjustment member comprises a strap that extends through the bores.

* * * * *